US007259312B2

(12) United States Patent
Jakes

(10) Patent No.: US 7,259,312 B2
(45) Date of Patent: Aug. 21, 2007

(54) PAGE-LIFTER AND PAGE-TURNING APPARATUS

(75) Inventor: Alfred Jakes, Vienna (AT)

(73) Assignee: Quidenus GmbH, Vienna (AT)

( * ) Notice: Subject to any disclaimer, the term of this patent is extended or adjusted under 35 U.S.C. 154(b) by 134 days.

(21) Appl. No.: 11/039,487

(22) Filed: Jan. 19, 2005

(65) Prior Publication Data

US 2006/0048631 A1 Mar. 9, 2006

(51) Int. Cl.
*G10G 7/00* (2006.01)

(52) U.S. Cl. ..... 84/486; 40/476

(58) Field of Classification Search ..... 84/486, 84/487, 489, 490; 40/476, 531
See application file for complete search history.

(56) References Cited

U.S. PATENT DOCUMENTS 4,644,675 A * 2/1987 Berger et al. ..... 40/531
4,677,778 A * 7/1987 Sorimachi et al. ..... 40/476
6,049,033 A * 4/2000 Dallas ..... 84/486
6,830,453 B2 12/2004 Jung
2004/0107612 A1 6/2004 Jung

FOREIGN PATENT DOCUMENTS

| | | |
|---|---|---|
| DE | 80 28 569.4 U1 | 12/1981 |
| EP | 1 426 197 A1 | 6/2004 |
| WO | 00/35680 | 6/2000 |
| WO | 02/49858 A1 | 6/2002 |

* cited by examiner

*Primary Examiner*—Lincoln Donovan
*Assistant Examiner*—Jianchun Qin
(74) *Attorney, Agent, or Firm*—Laurence A. Greenberg; Werner H. Stemer; Ralph E. Locher

(57) ABSTRACT

A device for lifting a page of a stack of pages with a binding or stitching, in particular of a book of music, has a drive for at least one lifting element and a supporting surface for the page. The at least one lifting element is driven in a rotational movement about a drive shaft by the drive via the drive shaft. The drive is mounted such that it can be pivoted about at least one axis of rotation that encloses an acute angle α with respect to the plane of the supporting surface.

16 Claims, 5 Drawing Sheets

PAGE-LIFTER AND PAGE-TURNING APPARATUS

BACKGROUND OF THE INVENTION

Field of the Invention

The invention relates to a device for turning over sheets of a stack of pages that are either bound or stitched, in particular for turning pages of a music book. The device has a drive for at least one lifting element and a supporting surface for the page.

A device of this type are known, for example from my earlier international patent publication WO 00/35680. There, a device for turning over the pages of books, books of music and the like is disclosed, which has a carrier for a book, book of music and the like. A shaft is provided normally on the carrier, two arms are fixed to the shaft, arranged normally on the shaft and opposite each other, so that they are located parallel to the carrier and at a distance from the latter. A drive motor is provided for the shaft and a page lifter is provided on one side of the shaft, a second page lifter is provided symmetrically in relation to the shaft, the two page lifters being assigned at least one motor which is independent of the drive motor for the shaft and it is possible for the shaft to be driven in both directions of rotation by way of the motor.

German Gebrauchsmuster (utility model) DE 80 28 569 U describes a page turning device whose turning stirrup can be moved over a desk, transversely with respect to the turning fold, at a distance between the initial thickness of the stack of pages and the stroke of a page raising device.

The disadvantage with these devices is that only a small number of pages can be turned over reliably and without interruption, since the height of the stack of pages whose pages are to be turned over decreases continuously and, as a result, reliable lifting of the uppermost page of the stack of pages by the page lifting apparatus is no longer ensured.

SUMMARY OF THE INVENTION

It is accordingly an object of the invention to provide a page-lifter and page turning apparatus, which overcomes the above-mentioned disadvantages of the heretofore-known devices and methods of this general type and which permits an uppermost page of a stack of pages with a binding to be lifted reliably, the stack of pages having any desired height and the device not having to be readjusted.

With the foregoing and other objects in view there is provided, in accordance with the invention, a device for lifting a page of a stack of pages, preferably in a bound or loose-leaf bound book, comprising:

a support with a supporting surface for supporting the page to be turned;

a lifting element rotatably mounted about a drive shaft;

a drive associated with said drive shaft for driving said lifting element in the rotational movement via said drive shaft, said drive being pivotally mounted about at least one axis of rotation enclosing an acute angle $\alpha$ with respect to a plane of said supporting surface.

In other words, the objects of the invention are achieved with the at least one lifting element that can be driven by a drive shaft in a rotational movement about a drive shaft, and the drive is mounted such that it can be pivoted about at least one axis of rotation which is at an acute angle $\alpha$ to the plane of the supporting surface.

Furthermore, a mid-axis running through the drive shaft forms with the axis of rotation an acute angle $\beta$, which faces the drive shaft. The orthogonal parallel projection of the mid-axis of the drive shaft onto the plane of the supporting surface in turn forms an acute angle $\gamma$ with an edge of the page running at right angles to the binding, the drive shaft pointing away from the binding.

In this case, the term acute angle designates any angle with a value of less than 90°. On account of the skewed position of the device in relation to the supporting surface and thus to the surface of the page, the page can be turned over reliably. It has proven to be particularly advantageous if the angle $\alpha$ has a value between 50° and 70°, the angle $\beta$ has a value between 45° and 90°, and here in particular a value of 75°±5°, and the angle $\gamma$ has a value of 15° to 45°.

In a preferred embodiment of the invention, the lifting element acts in the corner region of a page. On account of the skewed position of the device, mentioned above, the lifting of the page by the lifting element is carried out in a movement which corresponds to turning over the page with the finger.

In an economical variant of the invention, the at least one lifting element is in one piece with the drive shaft. In another embodiment, the at least one lifting element is connected to the drive shaft via a plug-in or screw connection. This has the advantage that the lifting element can be replaced simply if necessary.

In order to ensure reliable lifting of the page, the at least one lifting element has an end piece which comes into contact with the page.

It is particularly advantageous if the end piece consists of a resilient material and, furthermore, of a material with a high coefficient of friction with respect to the page.

In a further embodiment, the at least one lifting element is produced from resilient material. This provides a high level of flexibility of the device with regard to the height of the stack of pages.

The drive can be pivoted counter to the restoring force of at least one restoring element; as a result, the deflection of the drive is restricted and the end piece remains in contact with the surface of the page to be lifted. At the same time, the restoring element, for example a steel spring, defines the contact pressure with which the end piece acts on the page.

The invention has proven worthwhile in an apparatus for turning over pages of a stack of pages which has a device according to the invention and also at least one page turning apparatus for turning over a page lifted by the device.

Other features which are considered as characteristic for the invention are set forth in the appended claims.

Although the invention is illustrated and described herein as embodied in a page-turning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
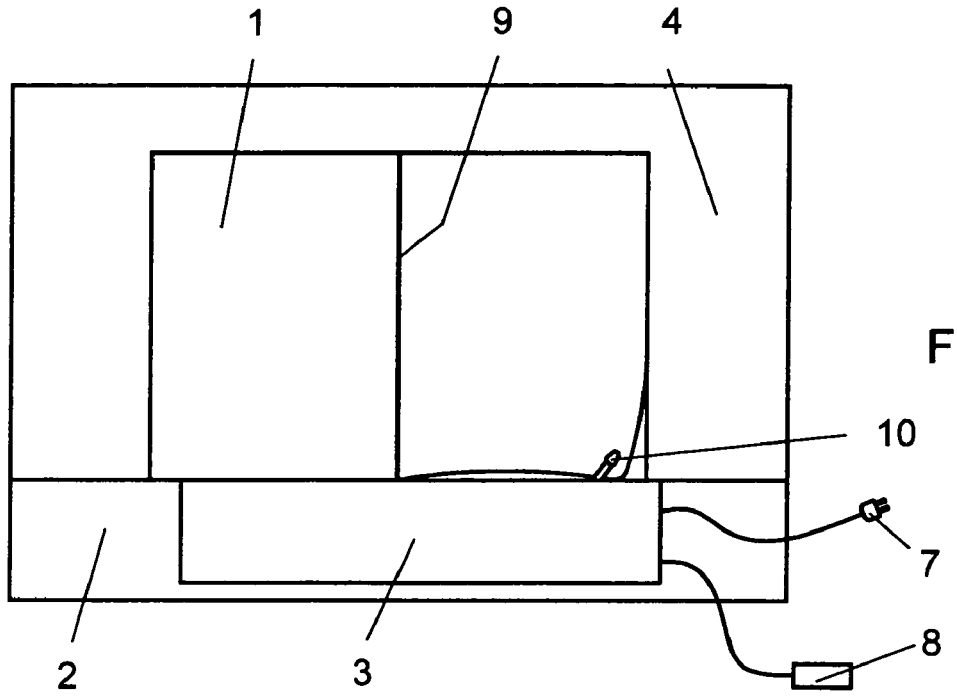
FIGS. 1A-1C show a desk or music stand with an integrated page turning apparatus for a book of music utilizing the device according to the invention for loosening and lifting a page, and also a schematic illustration of the page turning operation.
Figure 1B:
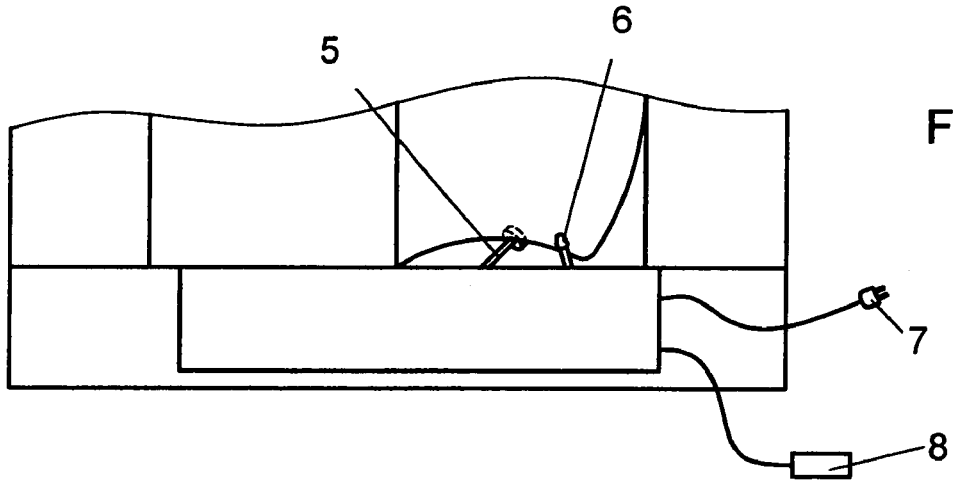
Figure 1C:
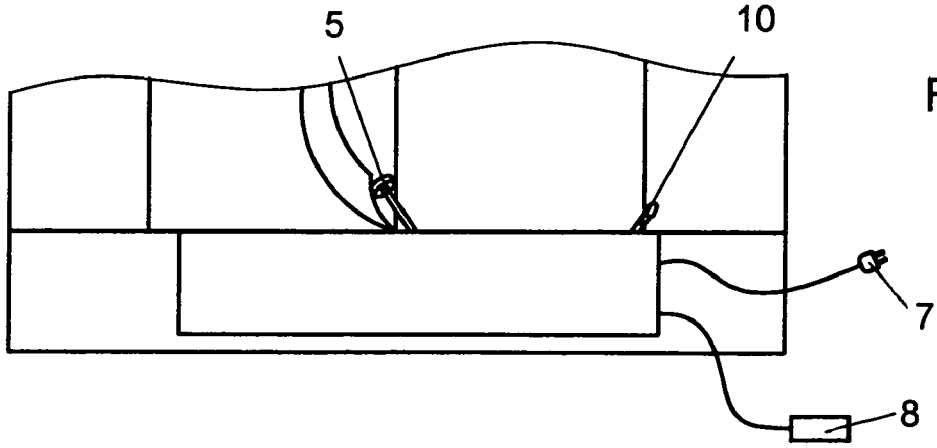

Referring now to the figures of the drawing in detail and first, particularly, to FIGS. 1A-1C thereof, there is shown the use of the device according to the invention for turning the pages of a book of music 1. For this purpose, the book of music 1 is placed on a desk 2, to which a housing 3 is fixed. For this purpose, the desk 2 has a supporting surface 4 which, for example, is constructed as a rectangular plate. The supporting surface can have any conceivable shape; it is merely necessary for it to be possible to place the book, exercise book etc. flat. Likewise, the desk 2 can be formed by a commercially available music stand, to which the housing 3 is fixed.

The housing 3 accommodates a device for lifting and loosening a page and a page turning apparatus 5 for turning over the lifted page 6. Power supply into the housing 3 is provided via a mains plug 7 for power supply. It will be understood, of course, that the device may also be operated with a battery, such as a rechargeable battery pack, or any other power source. A cable further connects to a switching element 8 which causes the pages of the book of music 1 to be turned. For example, the switch is a foot switch or foot pedal 8. Again, it should be clear to those of skill in the art that the page turning process may also be triggered by other means, such as, for instance, by a MIDI trigger if the corresponding music is MIDI programmed or by a rhythm or music-recognition system.

In the illustrated embodiment, the pages of the book of music 1 are turned over by actuating the foot switch 8. First of all, a lifting element 10 moves in a spinning movement over the bottom right corner of a page 6 located uppermost and belonging to the book of music 1. An end piece 11 located on the lifting element 10 (FIG. 2) displaces the bottom right corner of the page 6 in the direction of the fold 9 of the book of music 1, so that the sheet or page 6 is separated from a sheet lying underneath. Likewise, embodiments of the invention are possible wherein the lifting element 10 acts in a different region, preferably on another corner or edge of the page 6.

In order to turn over the lifted page 6, the page turning apparatus 5 engages under the arched page 6 and turns the latter over. Page turning apparatuses are sufficiently well known from the prior art. For example, an apparatus as disclosed in my above-mentioned WO 00/35680, in combination with the present invention, can be employed as an apparatus for turning over pages of a stack of pages with a binding. In this embodiment of the invention, the page turning apparatus 5 is an arm which executes a pivoting movement running parallel to the plane of the book of music 1 put in place, similar to a windshield wiper. This movement is synchronized with the rotational movement of the lifting element 10. In another embodiment of the invention, the page turning apparatus 5 is located, for example, in the region of the upper edge of the book of music 1.

Figure 2:
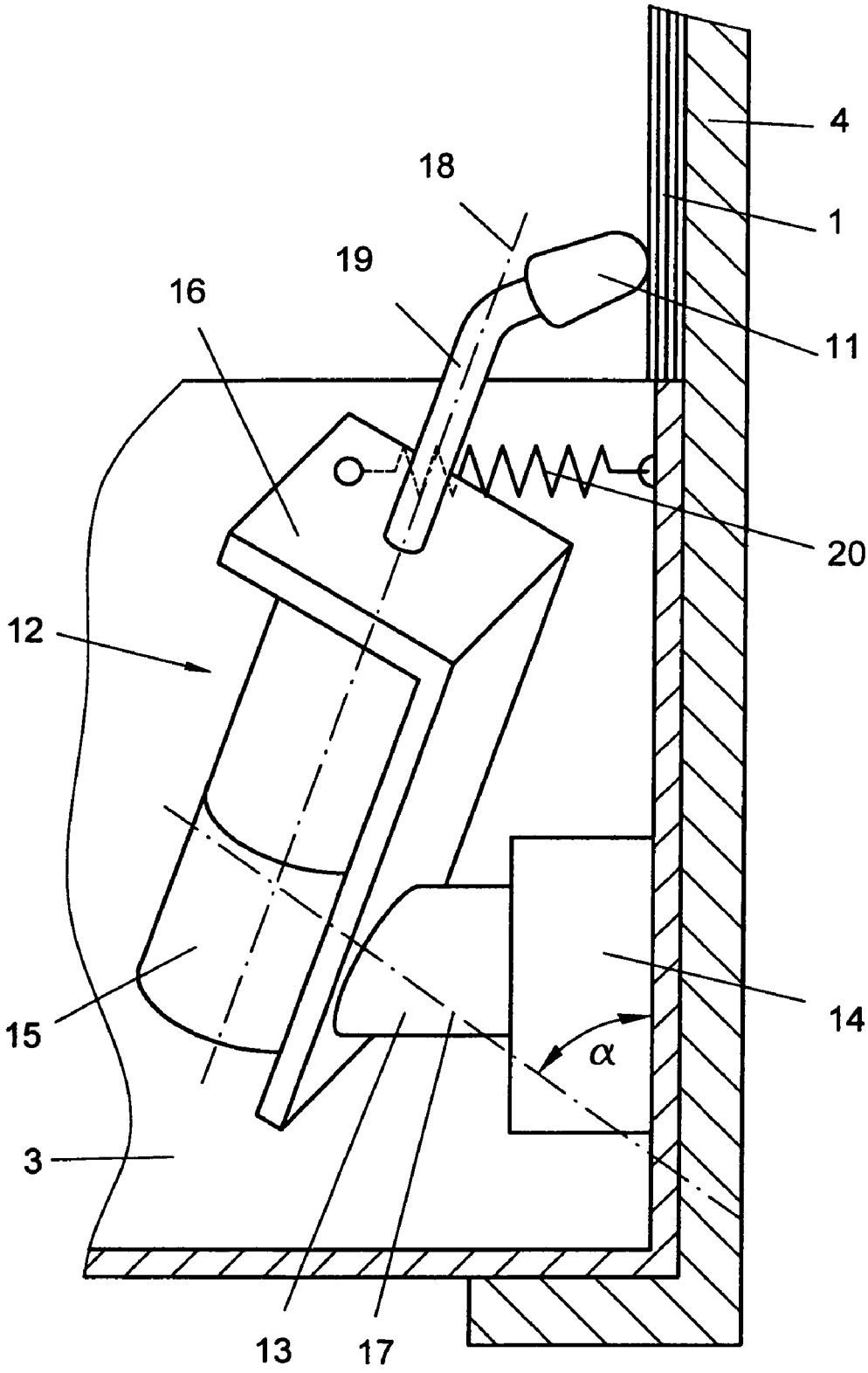
FIG. 2 is a broken-away view of the device for lifting and loosening a page shown in FIG. 1, in a detailed side view without the front cover of the housing.
Figure 3:
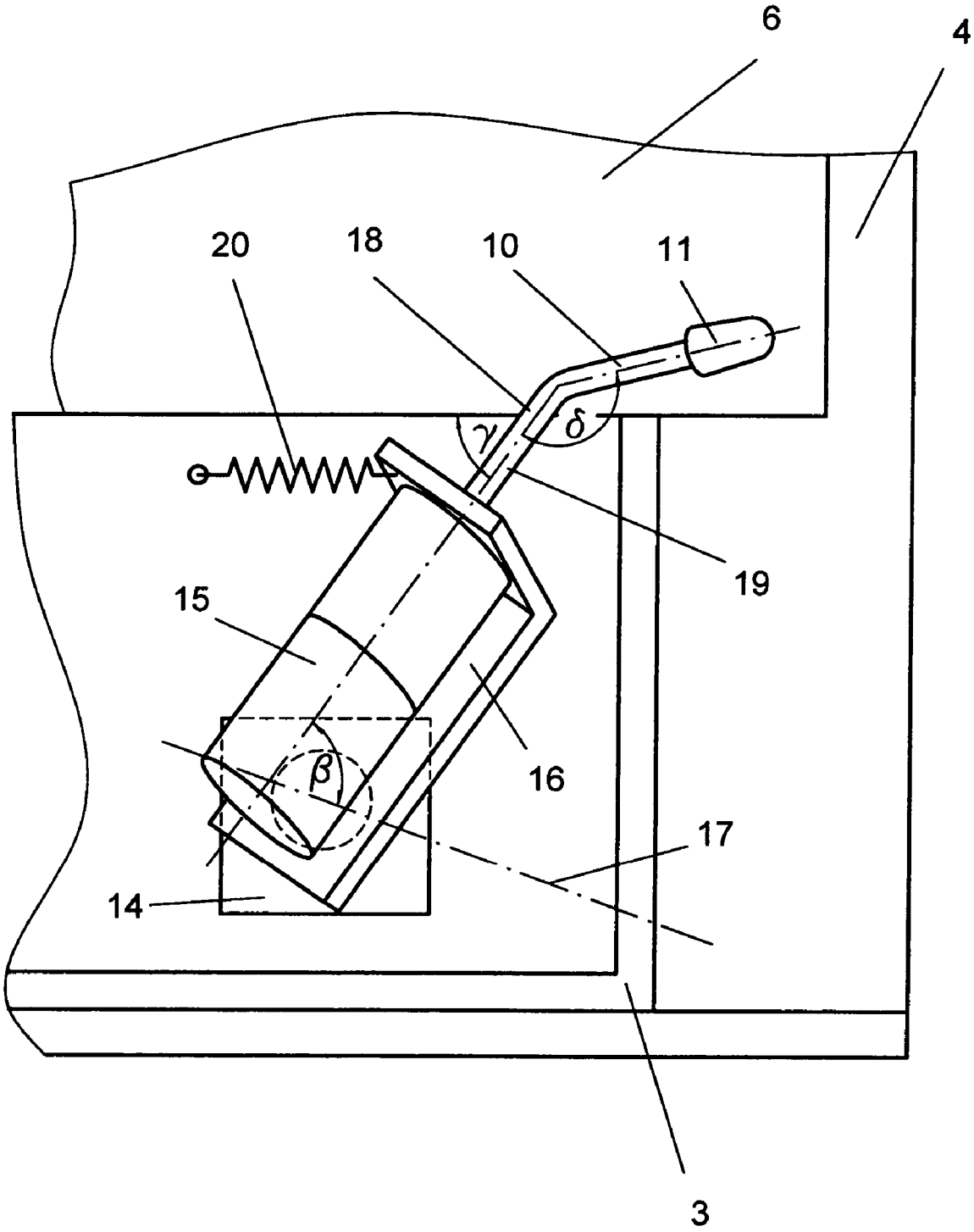
FIG. 3 is a view of the device for lifting and loosening a page from FIG. 1 in a detailed view from the front, again with the front cover of the housing removed.
Figure 4:
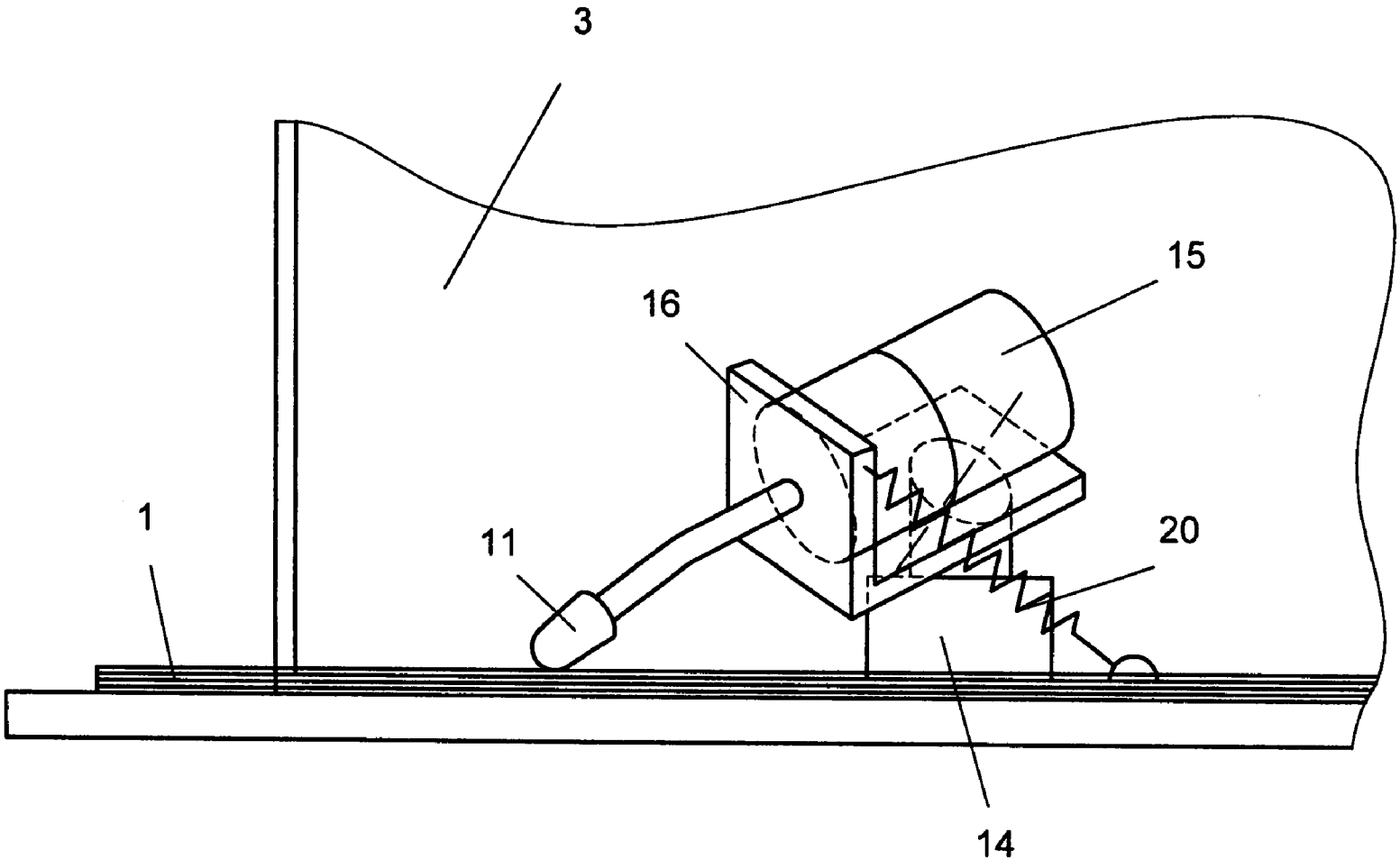
FIG. 4 is a similar view of the device for lifting and loosening a page from FIG. 1 in a detailed view from above.

FIGS. 2 to 4 show, in schematic form, the device 12 for lifting, i.e., loosening or singling the page 6. The device 12 is fixed to the housing 3 via a wedge-like support 13, illustrated in FIG. 2, and a base 14. A drive 15 is pivotally mounted via a holder 16, an axis of rotation 17 of the drive 15 intersecting the plane of the supporting surface 4 at an acute angle $\alpha$, which preferably lies between 50° and 70°.

The drive 15 can be an electric motor, such as a geared motor or a stepping motor. In another variant of the invention, the drive 15 is not located in the holder 16 but is directly pivotally mounted. The axis of rotation 17, more precisely that of the leg facing the support 13, encloses with the mid-axis 18 of a drive shaft 19 an angle $\beta$ of about 75° in the present embodiment of the invention. Thus, the mid-axis 18 in this embodiment does not run parallel to the plane of the supporting surface 4.

The orthogonal parallel projection of the mid-axis 18 of the drive shaft 19 onto the plane of the supporting surface 4 forms an acute angle $\gamma$ with an edge of the page 6 running at right angles to the binding 9, the drive shaft 19 pointing away from the binding 9. The angle $\gamma$ advantageously has a value between 15° and 45°.

Connected to the drive 15 along the mid-axis 18, either in a stationary manner or via a joint, is a drive shaft 19. The drive shaft 19 is adjoined by the lifting element 10, the lifting element 10, as illustrated in FIG. 3, being at an angle $\delta$ with respect to the drive shaft 19. This angle is preferably $\delta$=135°.

The lifting element 10 has at its end an end piece 11 which, in a preferred embodiment, is fabricated from soft rubber. This has a high elasticity, which permits the device 12 to turn the pages reliably of, for example, books of music of different thickness, without corrections to the distance of the lifting element 10 with respect to the page 6 having to be made. Likewise, the rubber material has a high coefficient of friction with respect to the material from which the page 6 is made and which, for example, can be paper but also plastic. The adjective "high," in this context, is defined relative to the rigidity, size, and weight of the type of page to be turned, by the material of the page, and the like. Soft rubber, silicone, or similar tacky materials are well suited for the task in the exemplary embodiment.

It is advantageous if the end piece 11 is fixed to the lifting element 10 such that it can be removed, for example by a screw or plug-in connection. In this way, in the event of the end piece 11 wearing, the latter can be replaced with a few actions.

Figure 5:
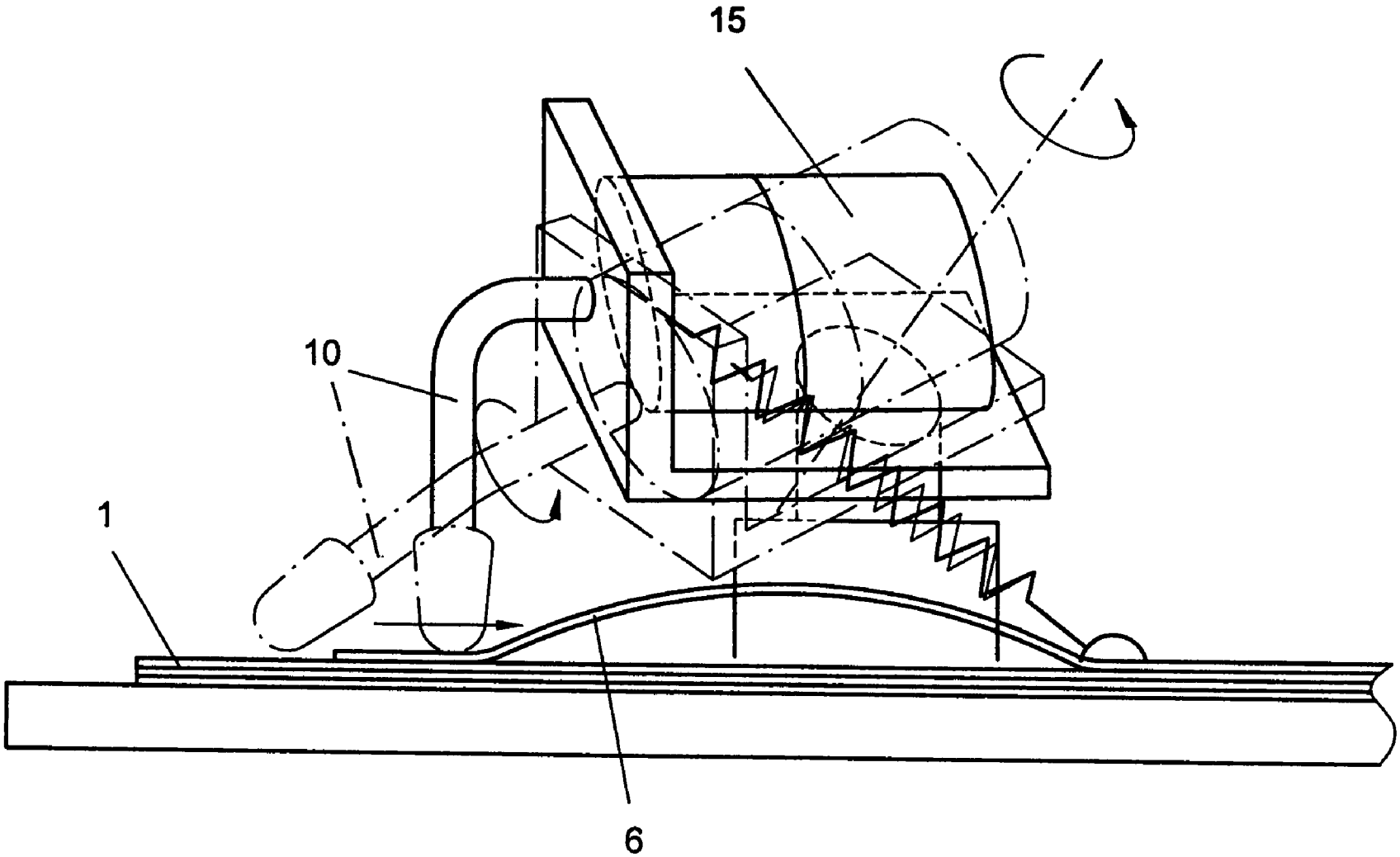
FIG. 5 illustrates the movement sequence of the device of FIGS. 2-4 during the lifting of a page.

In another variant of the invention, the lifting element 10 is fabricated from resilient material, while the end piece 11 is fabricated either from metal with a high surface roughness or likewise from plastic. FIG. 5 illustrates the movement of the lifting element 10 and of the drive 15 when lifting and loosening the page 6. The drive 15 effects rotation of the drive shaft 19 about its mid-axis 18. As a result, the lifting element 10 moves from a starting position, illustrated dash-dotted, with its end piece 11 on a substantially circular path in the counterclockwise direction, until the end piece 11 touches the page 6.

On account of the resistance of the material of the page 6, the drive 15 pivotally mounted on the axis of rotation 17 rotates, the drive 15 being controlled in such a way that, when encountering resistance, the motor output is increased as far as a defined maximum output. The maximum rotation of the drive 15 about the axis of rotation 17 is restricted by a spring 20. Instead of steel springs, other restoring elements known to those skilled in the art can also be used. This carries out the regulation of the pressure with which the end piece 11 acts on the material of the page 6.

If the lifting element 10 moves further, then the frictional forces between the end piece 11 and the page 6 are higher than that between the uppermost page 6 and a stack of pages 1 lying underneath. Therefore, the page 6 is loosened from the latter. The page turning apparatus 5 illustrated in FIG. 1 moves between page 6 and the stack of pages 1 and turns the page 6 over in a movement executed parallel to the plane of the book of music.

During this time, the drive 15 has returned back into its initial position and, as soon as the page 6 as being grasped by the page turning apparatus 5, the lifting element 10 rotates onward in the counterclockwise direction until the starting position is once more reached.

The embodiment of the invention described here is not to be viewed in a restrictive manner. It is not restricted to lifting pages of an exercise book or book; likewise it is suitable, for example, for turning the pages in plastic covers, as is usual inter alia in ring binders.

This application claims the priority, under 35 U.S.C. § 119, of Austrian patent application No. 1508/2004, filed Sep. 9, 2004; the entire disclosure of the prior application is herewith incorporated by reference.

I claim:

1. A device for lifting a page of a stack of pages, comprising:

a support with a supporting surface for supporting the page to be turned;

a lifting element drivably mounted in a rotational movement about a drive shaft;

a drive associated with said drive shaft for driving said lifting element in the rotational movement via said drive shaft, said drive being pivotally mounted about at least one axis of rotation enclosing an acute angle $\alpha$ with respect to a plane of said supporting surface.

2. The device according to claim 1, wherein a mid-axis running through said drive shaft encloses an acute angle $\beta$ with said axis of rotation, the angle $\beta$ facing the drive shaft.

3. The device according to claim 2, wherein the angle $\beta$ has a value between 45° and 90°.

4. The device according to claim 2, wherein the angle $\beta$ has a value of 75°±5°.

5. The device according to claim 1, wherein an orthogonal parallel projection of the mid-axis of said drive shaft onto the plane of said supporting surface encloses an acute angle $\gamma$ with an edge of the page running at right angles to a binding of the stack of pages, said drive shaft pointing away from the binding.

6. The device according to claim 5, wherein the angle $\gamma$ has a value of 15° to 45°.

7. The device according to claim 1, wherein the angle $\alpha$ has a value between 50° and 70°.

8. The device according to claim 1, wherein said lifting element is disposed to act in a corner region of the page to be turned.

9. The device according to claim 1, wherein said at least one lifting element is integrally formed in one piece with said drive shaft.

10. The device according to claim 1, wherein said at least one lifting element is connected to said drive shaft via a plug-in connection or a screw connection.

11. The device according to claim 1, which comprises an end piece on said at least one lifting element, said end piece being disposed to come into contact with the page.

12. The device according to claim 11, wherein said end piece consists of a resilient material.

13. The device according to claim 11, wherein said end piece consists of a material having a high coefficient of friction with respect to the page.

14. The device according to claim 1, wherein said at least one lifting element is fabricated from resilient material.

15. The device according to claim 1, which comprises at least one restoring element, and wherein said drive is pivotally mounted counter to a restoring force of said at least one restoring element.

16. An apparatus for turning pages of a stack of pages, comprising: the device according to claim 1 for lifting a page, and at least one page turning apparatus for turning the page lifted by the device.

* * * * *